US006165033A

United States Patent [19]

Cugini

[11] Patent Number: 6,165,033

[45] Date of Patent: Dec. 26, 2000

[54] ANTIFREEZE CIRCULATING DEVICE

[76] Inventor: Daniel J. Cugini, 33 Temi Rd., Holliston, Mass. 01746

[21] Appl. No.: 09/453,210

[22] Filed: Dec. 3, 1999

[51] Int. Cl.[7] ..... B63H 21/10

[52] U.S. Cl. ..... 440/88

[58] Field of Search ..... 440/3, 49, 88, 440/89, 113, 900

[56] References Cited

U.S. PATENT DOCUMENTS

| | | | |
|---|---|---|---|
| 3,202,123 | 8/1965 | Goodfriend | 440/88 |
| 4,986,319 | 1/1991 | Ahlefeld . | |
| 5,035,208 | 7/1991 | Culp . | |
| 5,069,259 | 12/1991 | Ahlefeld . | |
| 5,071,377 | 12/1991 | Saunders et al. | 440/88 |
| 5,263,885 | 11/1993 | Montague . | |
| 5,337,774 | 8/1994 | Boyd . | |
| 5,393,252 | 2/1995 | Brogdon | 440/88 |
| 5,397,256 | 3/1995 | Bidwell . | |
| 5,725,403 | 3/1998 | Ridolfo . | |
| 5,823,836 | 10/1998 | Anderson . | |
| 6,089,934 | 7/2000 | Biggs et al. | 440/88 |

*Primary Examiner*—Stephen Avila
*Attorney, Agent, or Firm*—Richard C. Litman

[57] ABSTRACT

An apparatus for flushing the cooling system of a marine motor is disclosed. The apparatus includes a catch basin having an immersion pump located therein. A pair of suction cup sealing members, joined together by a U-shaped spring, are placed over the coolant intakes of the motor. One of the suction cups communicates via a hose with the immersion pump. The immersion pump is supplied with electrical energy either from the water craft's on-board battery or from an auxiliary battery. The catch basin is filled with a quantity of anti-freeze solution and the immersion pump and the motor are turned on in that order. The anti-freeze solution is then repeatedly circulated through the engine cooling system and is discharged through the engine cooling system outlet back into the catch basin.

12 Claims, 8 Drawing Sheets

ANTIFREEZE CIRCULATING DEVICE

BACKGROUND OF THE INVENTION

1. Field of the Invention

The present invention relates to an apparatus for flushing the cooling system of a marine motor.

2. Description of the Related Art

Most marine outboard and inboard motors have an outdrive portion that supports a propeller and is immersed in water when the motor is being used to propel a water craft over the surface of a body of water. The outdrive portion of the marine motor is usually equipped with cooling water intake ports which are positioned under the surface of the body of water during the operation of the marine motor. The marine motor has a built-in water pump which draws water from the body of water, circulates the water throughout the cooling passages of the marine motor, and discharges the cooling water through the motor's exhaust. Thus, the waters being traveled by the water craft are used to cool the engine or motor of the water craft.

During the winter months when the water craft or boat is removed from the water, some water will remain trapped in the cooling passages of the engine. When temperatures drop below the freezing point, the water trapped in the cooling passages of the engine may freeze and expand causing damage to the engine. Further, if the boat or water craft is operated in salt water, the salt water left in the cooling passages of the engine can lead to corrosion of the engine block. For these reasons, many systems for purging water from the cooling system of a boat motor have been proposed. Listed below are references which show examples of systems for purging water from the cooling systems of boat motors. However, none of these references teach or suggest the unique structure of the catch basin of the present invention which allows the flushing of the boat motor cooling system without the need to immerse the outdrive portion of the motor in an anti-freeze solution.

U.S. Pat. No. 5,823,836, issued to Kenneth J. Anderson on Oct. 20, 1998, is directed to a marine motor flushing device. The device includes a pair of suction cups that are placed over the coolant intakes of the marine motor. One of the suction cups has a fitting for the attachment of a "Y" connector. A water supply hose and a lubricating fluid container are each attached to a respective branch of the "Y" connector to conduct a water and lubricating fluid mixture through the cooling system of the marine motor.

U.S. Pat. No. 5,725,403, issued to James T. Ridolfo on Mar. 10, 1998, is directed to a tank for holding an aqueous detergent mixture. The propeller of a marine motor is immersed in the tank and the motor is started, thus allowing the motor's coolant pump to circulate the detergent mixture through the motor in order to flush the motor's cooling system.

U.S. Pat. No. 5,397,256, issued to Glenn P. Bidwell on Mar. 14, 1995, is directed to an apparatus for flushing a marine engine. The apparatus of Bidwell employs a pair of suction cup-like devices which are positioned over the coolant liquid intakes of the marine engine. One of the suction cup-like devices is movably supported by a hydraulic cylinder. As anti-freeze is supplied under pressure to the hydraulic cylinder, the suction cup-like device is pushed into sealing engagement with the surface around the coolant intakes. Further increases in the pressure of the anti-freeze opens a check valve which allows anti-freeze to flow into the coolant intakes of the engine.

U.S. Pat. No. 5,337,774, issued to Gary P. Boyd on Aug. 16, 1994, is directed to a marine engine winterizing system. The system of Boyd includes an anti-freeze storage tank and an anti-freeze recovery tank. The system of Boyd requires the outdrive of the marine engine to be immersed in the recovery tank such that the engine's water pump can draw anti-freeze from the recovery tank.

U.S. Pat. No. 5,263,885, issued to Michael J. Montague on Nov. 23, 1993, relates to a system for supplying anti-freeze to a marine engine during operation. The system of Montague includes an anti-freeze tank, an electronically controlled pump, and an electronically controlled valve. The pump and valve are operated to inject anti-freeze into the hose conducting coolant from the outdrive to the engine block.

U.S. Pat. No. 5,069,259, issued to Marvin A. Ahlefeld on Dec. 3, 1991, and U.S. Pat. No. 4,986,319, issued to Marvin A. Ahlefeld on Jan. 22, 1991, relate to a clamping device for sealingly positioning a pair of sealing heads over the cooling water intakes of a marine engine. One of the sealing heads has a fitting that allows a hose to be connected to the sealing head for the purpose of supplying anti-freeze to the sealing head.

U.S. Pat. No. 5,035,208, issued to Edwin C. Culp on Jul. 30, 1991, relates to using a "Y" valve to alternatively connect a boat engine either to a source of a flushing liquid or to a source of anti-freeze.

None of the above inventions and patents, taken either singularly or in combination, is seen to describe the instant invention as claimed.

SUMMARY OF THE INVENTION

The present invention is directed to an apparatus for flushing the cooling system of a marine motor. The apparatus includes a catch basin having an immersion pump located therein. A pair of suction cup-like sealing members, joined together by a U-shaped spring, are placed over the coolant intakes of the motor. One of the suction cup-like members communicates via a hose with the immersion pump. The immersion pump is supplied with electrical energy either from the water craft's on-board battery or from an auxiliary battery. The catch basin is filled with a quantity of anti-freeze solution and the immersion pump and the motor are turned on in that order. The anti-freeze solution is then circulated through the engine cooling system and is discharged through the engine cooling system outlet back into the catch basin. Continued operation of the immersion pump and the engine will result in the continuous recirculation of the anti-freeze solution through the engine.

Accordingly, it is a principal object of the invention to provide a system which allows the flushing of a boat motor cooling system without the need to immerse the outdrive portion of the motor in an anti-freeze solution.

It is another object of the invention to provide an apparatus for flushing the cooling system of a marine motor which is portable and can be used almost anywhere without the need for special facilities.

It is a further object of the invention to provide an apparatus for flushing the cooling system of a marine motor which is simple and easy to use.

Still another object of the invention is to provide an apparatus for flushing the cooling system of a marine motor which reduces the amount of waste anti-freeze solution generated by the flushing process.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
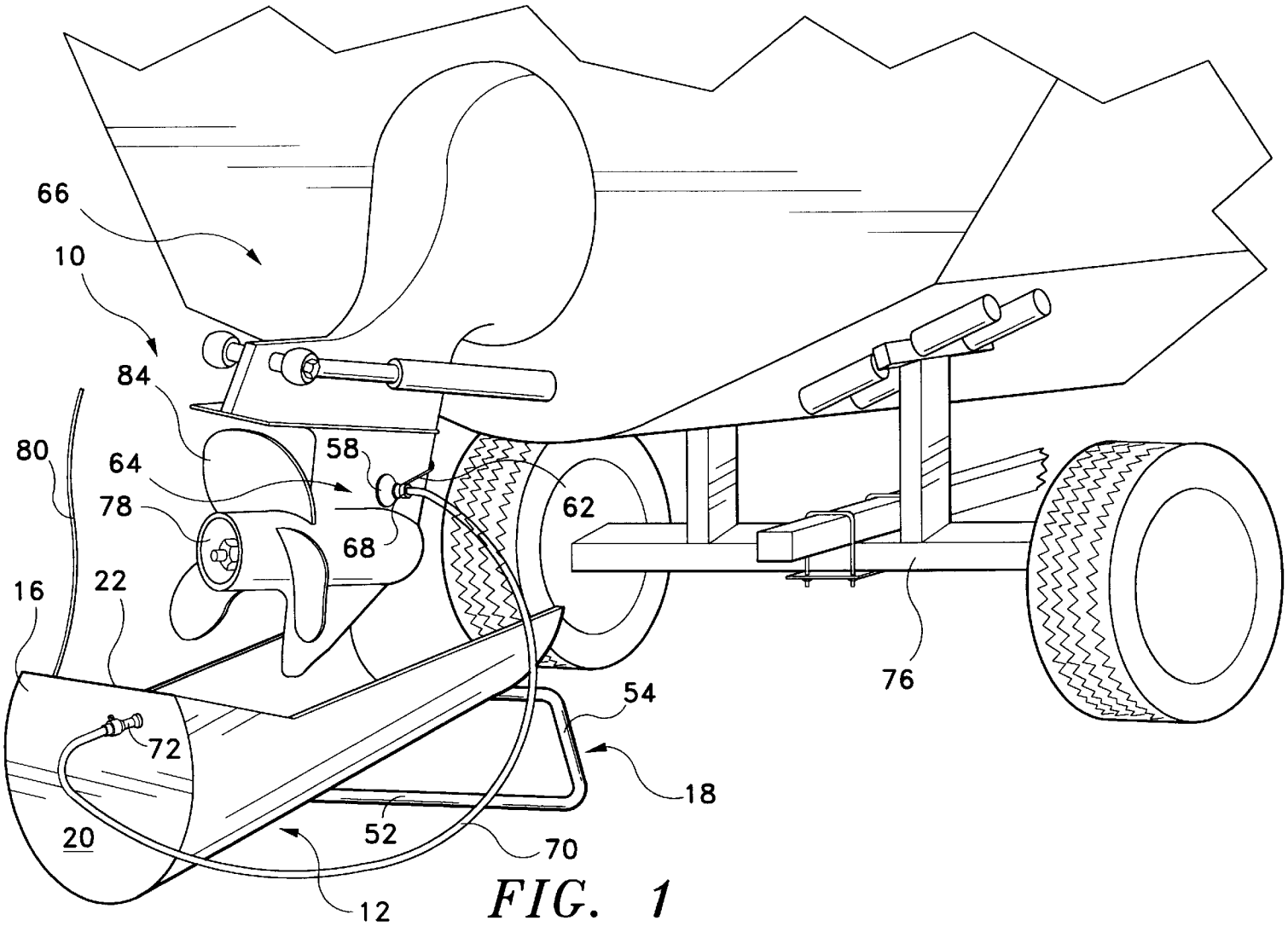
FIG. 1 is an environmental view of the first embodiment of the apparatus of the present invention for flushing the cooling system of marine motors.
Figure 2:
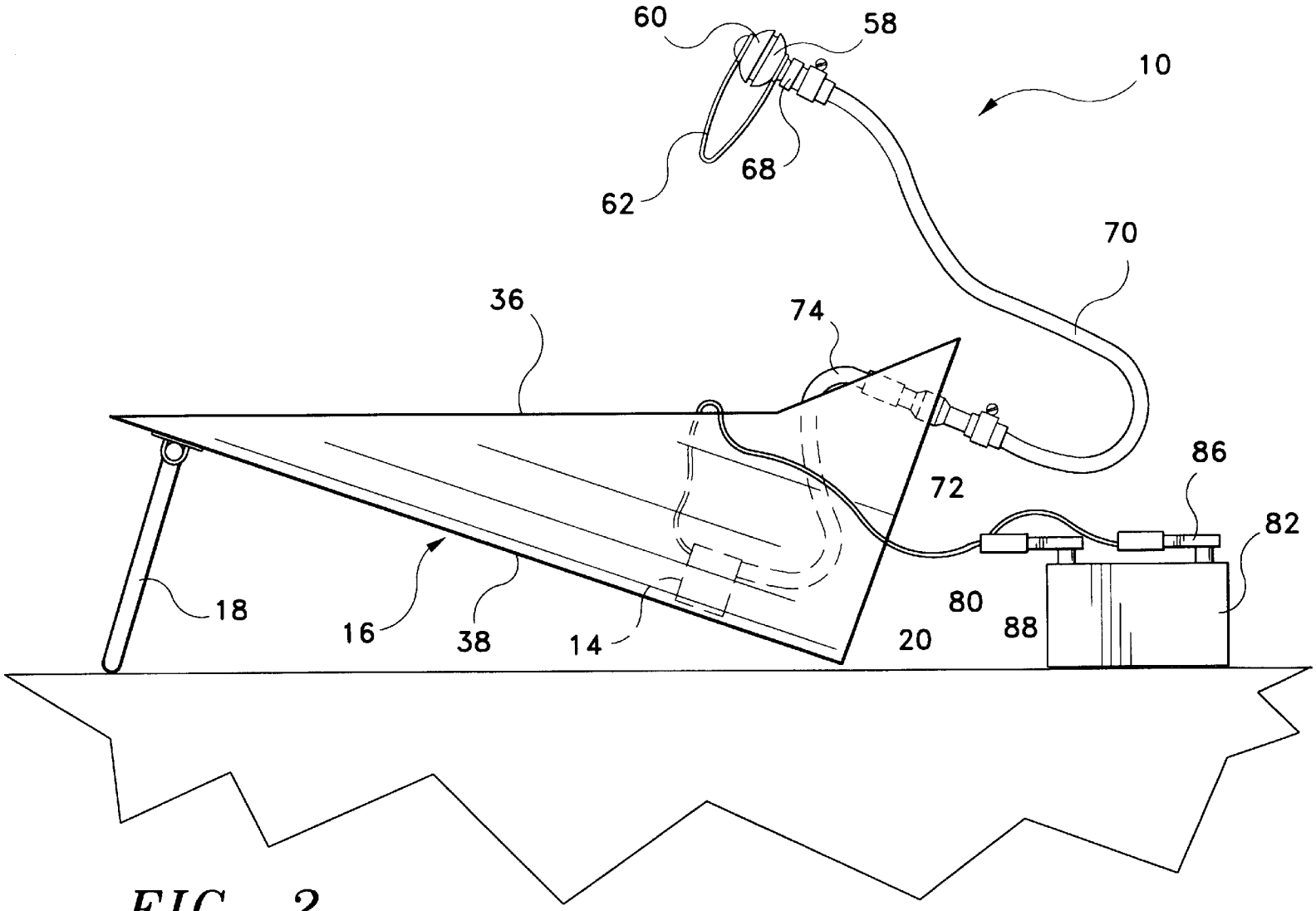
FIG. 2 is a view in side elevation of the first embodiment of the apparatus of the present invention for flushing the cooling system of marine motors.
Figure 3:
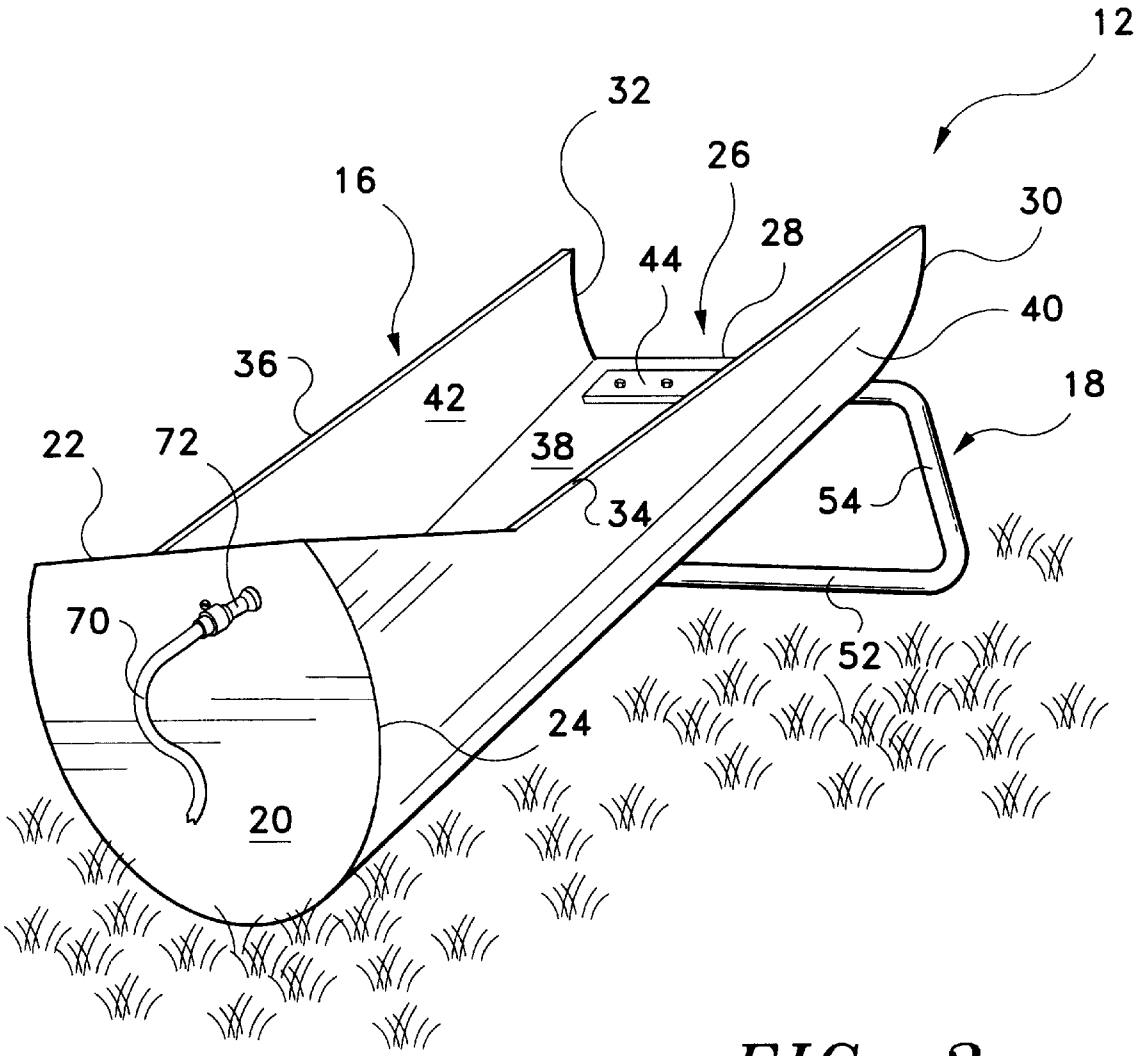
FIG. 3 is a perspective view of the first embodiment of the catch basin for use with the apparatus of the present invention for flushing the cooling system of marine motors.
Figure 4:
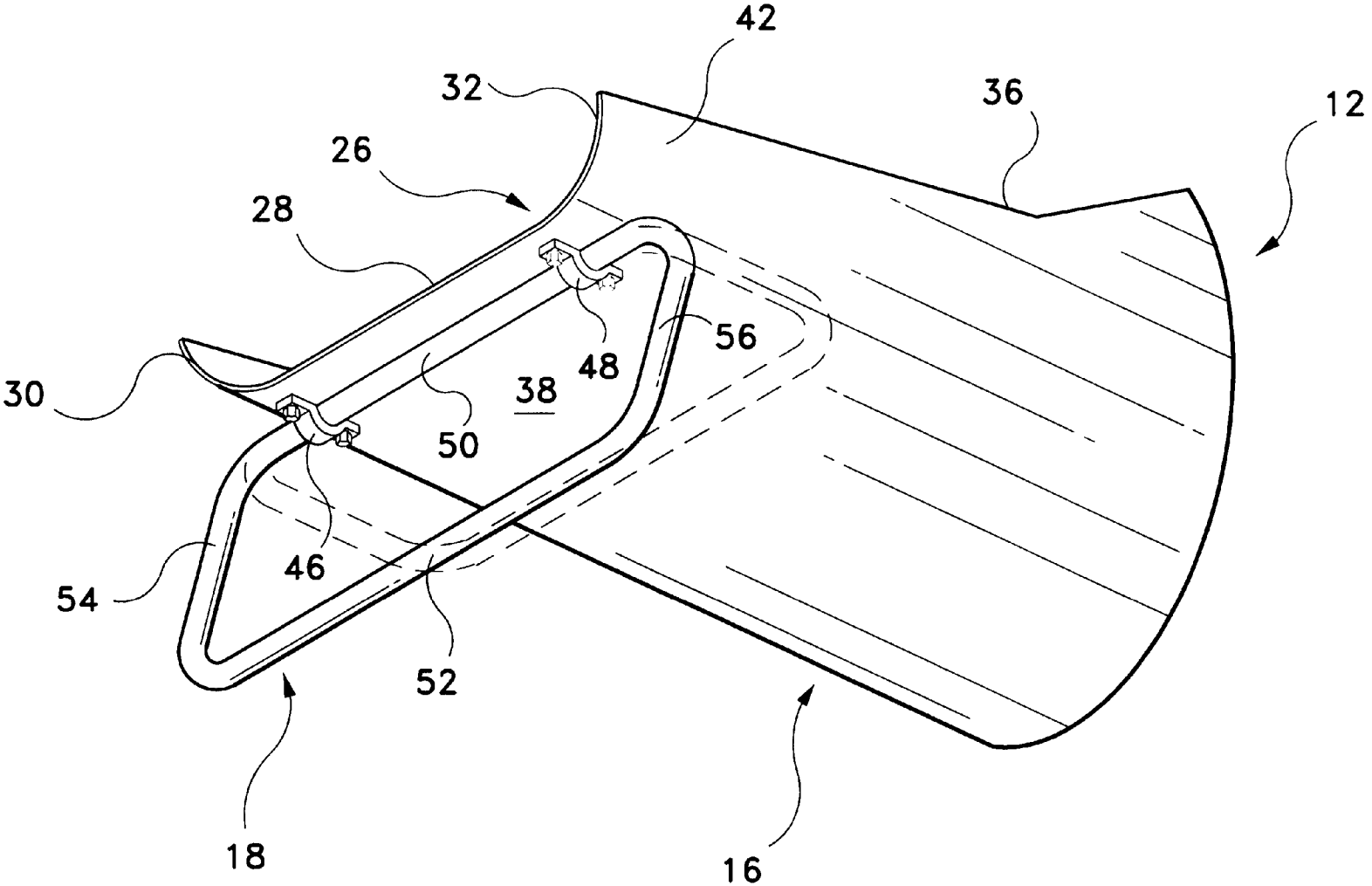
FIG. 4 is a bottom perspective view of the first embodiment of the catch basin for use with the apparatus of the present invention for flushing the cooling system of marine motors.
Figure 5:
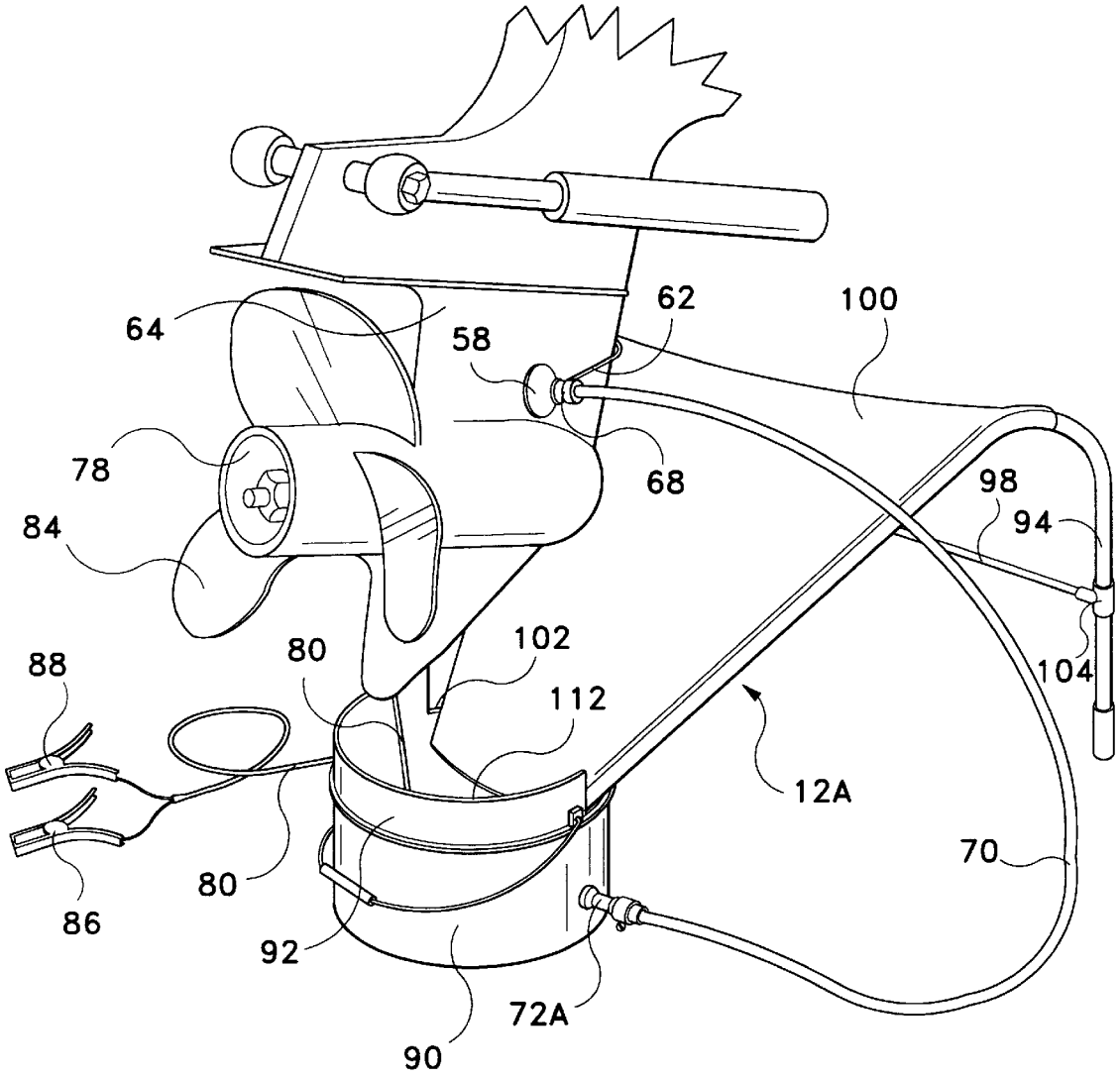
FIG. 5 is an environmental view of the second embodiment of the apparatus of the present invention for flushing the cooling system of marine motors.
Figure 6:
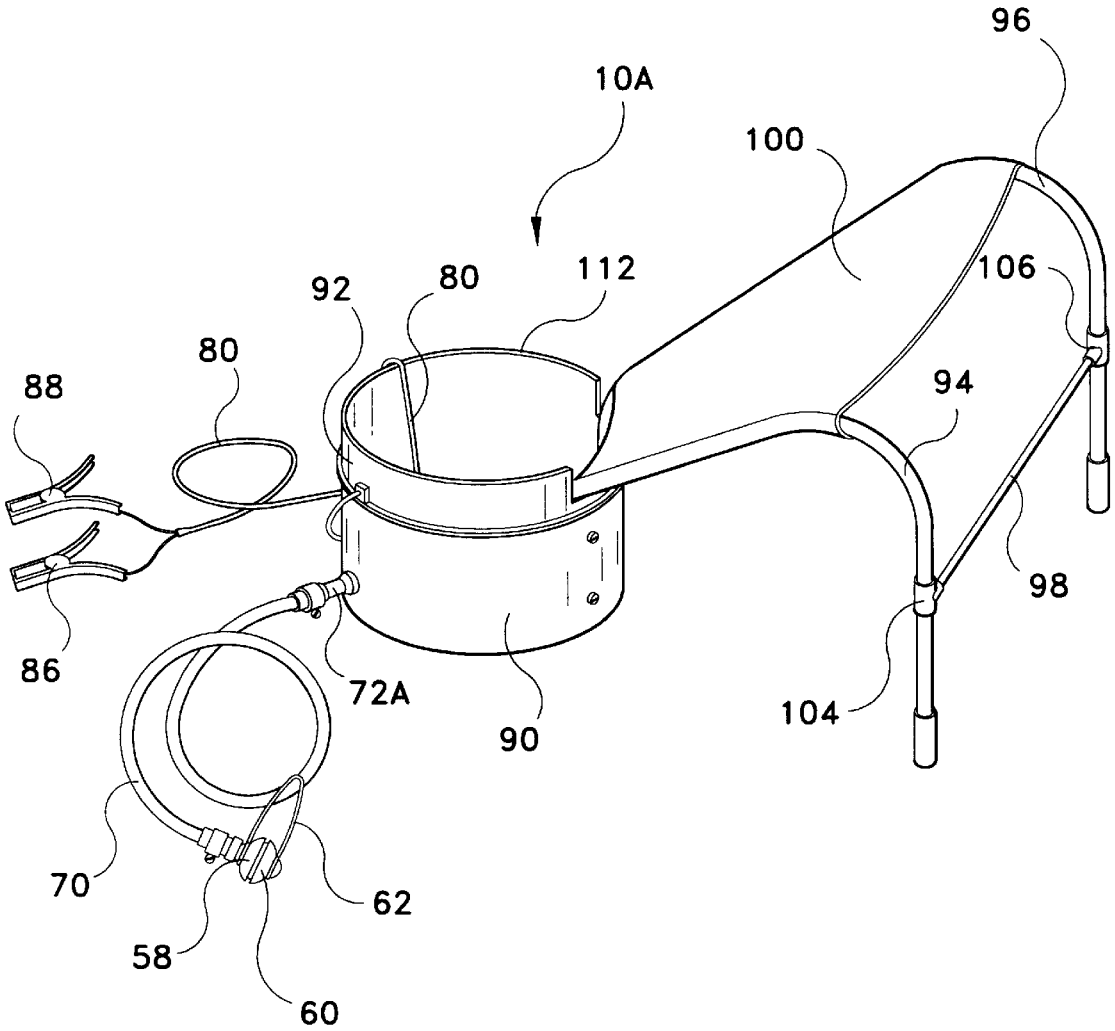
FIG. 6 is a perspective view of the second embodiment of the apparatus of the present invention for flushing the cooling system of marine motors.

The present invention is directed to a method and an apparatus for flushing the cooling system of a marine motor. Referring to FIGS. 1–4, the first embodiment 10 of the apparatus of the present invention for flushing the cooling system of marine motors can be seen. The apparatus 10 includes a catch basin 12 having an immersion pump 14 located therein. The catch basin 12 includes a liquid receptacle or vessel 16 and a pivoting support frame 18. The vessel 16 has an end wall 20 circumscribed by the major arc 24 of a circle and a chord which forms the top edge 22 of the end wall 20. The vessel 16 has an open end 26. The open end 26 is formed by a substantially flat bottom edge 28 and two curved side edges 30 and 32 which curve upward on either side of the bottom edge 28. The vessel 16 also has top lateral edges 34 and 36 on either side thereof. The top lateral edge 34 extends from the top of the side edge 30 of the open end 26 to the top edge 22 of the end wall 20 at a first end of the top edge 22 where the arc 24 also meets the top edge 22. The top lateral edge 36 extends from the top of the side edge 32 of the open end 26 to the top edge 22 of the end wall 20 at the second end of the top edge 22 where the top edge 22 again meets the arc 24. The top lateral edges 34 and 36 are of compound slope relative to the outline of the bottom 38 of the vessel 16. The compound slope of the top lateral edges 34 and 36 is readily apparent when the vessel 16 is viewed in side elevation as shown in FIG. 2. The portion of each of the top lateral edges 34 and 36 adjacent a respective one of the side edges 30 and 32, has a first slope relative to the outline of the bottom 38 of the vessel 16, and the portion of each of the top lateral edges 34 and 36 adjacent the top edge 22 has a slope that is steeper than the first slope relative to the outline of the bottom 38 of the vessel 16. The bottom 38 of the vessel 16 is substantially flat proximate the open end 26 of the vessel 16, and the sidewalls 40 and 42 generally follow the curve of the side edges 30 and 32 proximate the open end 26. The bottom 38 and the sidewalls 40 and 42 blend together to follow or approach the surface of a cylinder with decreasing distance from the end wall 20. The bottom 38 and the sidewalls 40 and 42 join the end wall 20 along the arc 24.

As an example, the vessel 16 can be fabricated using a substantially cylindrical drum having an open end and a closed end. The drum can then be cut longitudinally and along a diameter of the drum. The longitudinal cut would begin at the open end of the drum and extend for some distance toward the closed end of the drum. The cut is then angled upward as it progresses toward the closed end of the drum. The cut finally intersects the substantially circular end wall of the drum along a chord of the circular end wall, thus forming the top edge 22 and the end wall 20. The drum is preferably made of a flexible material such as plastic. The semi-circular open end of the cut drum is flattened in the middle to form the open end 26 of the vessel 16 and causing the sidewalls 40 and 42 to flare out. An elongated rigid plate 44 is riveted to the cut drum near the bottom edge 28 of the open end 26 to maintain the shape of the open end 26. The pivoting support frame 18 is then pivotally attached to the bottom 38 of the vessel 16, near the bottom edge 28 of the open end 26, using a pair of U-brackets 46 and 48.

The pivoting support frame 18 is substantially in the shape of a four sided plane figure. The pivoting support frame 18 has a top member 50, a bottom member 52, and a pair of lateral members 54 and 56. The top member 50 and the bottom member 52 are parallel to one another, and the lateral members 54 and 56 extend between the top member 50 and the bottom member 52. The U-brackets 46 and 48 and the bottom 38 cooperatively encircle the top member 50 to provide for the pivotal movement of the support frame 18 between the extended position (shown in solid line) and the folded position (shown in dashed line). The support frame 18 can be made from a single tube which is bent into the shape of the four sided figure of the support frame 18. With the support frame 18 in the extended position the open end 26 of the vessel 16 will be elevated above the bottom of the end wall 20 such that any liquid captured by the open top of the vessel 16 will collect into a pool near the bottom of the end wall 20. The support frame 18 is folded to allow for easier storage of the catch basin 12 when the catch basin is not in use. The U-brackets 46 and 48 and the bottom 38 engage the top member 50 with sufficient frictional force to maintain the support frame 18 in either the extended position or the folded position, as selected by the user, during normal operation of the apparatus 10.

The apparatus 10 also includes a pair of suction cup-like sealing members 58 and 60. The pair of suction cup-like sealing members 58 and 60 are joined together by a U-shaped spring 62. Each of the suction cup-like members 58 and 60 is positioned at the end of a respective arm of the U-shaped spring 62. The U-shaped spring 62 biases the suction cup-like members 58 and 60 toward one another such that force has to be exerted to move the suction cup-like members 58 and 60 far enough apart to allow the suction cup-like members 58 and 60 to be positioned over the coolant intakes at either side of the outdrive 64 of the motorboat 66. Further, the U-shaped spring 62 forces the suction cup-like members 58 and 60 into contact with the surfaces of the outdrive 64 which surround the coolant intakes of the motor of the boat 66. One of the suction cup-like members, suction cup-like member 58 in the illustrated example, has a fitting 68 that allows one end of the hose 70 to be coupled to the suction cup-like member. Thus the hose 70 is in fluid communication with the suction cup-like member 58.

The other end of the hose 70 is coupled to a fitting 72 which extends through the end wall 20 of the vessel 16. The fitting 72 is fixedly positioned within an opening in the end wall 20 and any gaps between the opening and the fitting 72 are sealed using any number of well known means. The other end of the fitting 72 is coupled to one end of the hose 74. The other end of the hose 74 is then coupled to the outlet of the immersion pump 14. Thus the outlet of the pump 14 is in fluid communication with the interior of the suction cup-like member 58 via the hoses 74 and 70. The arrangement using a fitting 72 which is fixed in position relative to the vessel 16 and then coupling a first hose 74 between the pump 14 and the fitting 72 and a second hose 70 between the fitting 72 and the suction cup-like member 58, has the advantage that the suction cup-like members 58 and 60 and consequently the second hose 70 can be moved about as desired by the user without the movement of the suction cup-like members 58 and 60 affecting the position of the pump 14 within the vessel 16.

To use the apparatus 10, the boat 66 must first be elevated above a supporting surface by, for example, placing the boat 66 on a boat trailer 76. The support frame 18 is then moved to the extended position and the catch basin 12 is positioned under the outdrive 64 of the boat motor. The projected area circumscribed by the edges 22, 34, 36, 28, 30, and 32, as projected onto a horizontal plane, should be large enough such that any liquid discharged from the exhaust 78 of the boat motor and from the area of the coolant intakes of the boat motor will fall into and be captured by the vessel 16 under the influence of gravity.

The pair of suction cup-like members 58 and 60 are then placed over the coolant intakes of the motor such that each of the suction cup-like members 58 and 60 cover the coolant intake on a respective side of the outdrive 64. As was previously indicated, the suction cup-like member 58 communicates via the hoses 70 and 74 with the immersion pump 14. The immersion pump 14 is supplied with electrical energy either from the water craft's on-board battery or from an auxiliary battery 82 via a power cable 80. When intended for connection to an auxiliary battery, the cable 80 should preferably terminate in a pair of spring loaded battery terminal clamps 86 and 88. The catch basin 12 is filled with a quantity of anti-freeze solution. The quantity of anti-freeze solution should at least equal the total volume of the cooling passages of the boat motor plus an amount of solution sufficient to keep the intake of the pump 14 submerged and the pump 14 primed at all times during the operation of the apparatus 10. As should be readily apparent from FIG. 2, the pump 14 should be placed as close to the end wall 20 as possible, i.e. as close to the lowest point of the internal volume of the vessel 16 as possible, in order to minimize the amount of solution required to keep the intake of the pump 14 submerged and the pump 14 primed. The immersion pump 14 and the motor are then turned on, in that order, with the power train to the boat propeller 84 in neutral. Turning on the immersion pump 14 has the effect of priming the coolant pump of the boat motor. Once the boat motor is turned on, the coolant pump of the boat motor will circulate the anti-freeze solution through the coolant passages of the boat motor and then discharge the anti-freeze solution through the exhaust 78 of the boat motor. The anti-freeze solution dripping from the exhaust 78 is captured by the vessel 16 and is recirculated to the coolant intake of the boat motor by the pump 14 which continuously supplies the coolant pump of the boat motor with anti-freeze solution. Thus, the anti-freeze solution is circulated through the engine cooling system and is discharged through the engine cooling system outlet back into the catch basin 12. Continued operation of the immersion pump 14 and the boat's engine will result in the continuous recirculation of the anti-freeze solution through the cooling system of the boat's engine, thus purging any water that has not been mixed with anti-freeze from the boat engine's cooling system.

Referring to FIGS. 5–8, a second embodiment 10*a* of the apparatus of the present invention for flushing the cooling system of marine motors can be seen. The main difference between the apparatus 10*a* and the apparatus 10 is that the apparatus 10*a* employs a second embodiment 12*a* of the catch basin of the present invention. The catch basin 12*a* includes a sump portion 90 in the form of a substantially cylindrical container having a closed bottom and an open top. The pump 14 is supported on the bottom of the sump portion 90 which is the lowest point of the catch basin 12*a*. The sump portion 90 has an opening its wall through which a fitting 72*a* extends. The fitting 72*a* is fixed to the sump portion 90, and a liquid-tight seal is formed around the opening through which the fitting 72*a* extends such that no liquid can leak through gaps between the fitting 72*a* the hole through which the fitting 72*a* extends. Such a seal can be formed, for example, by running a bead of silicone rubber sealant around the hole through which the fitting 72*a* extends. Alternatively, well known mechanical seals using threaded collars, washers, and/or o-rings may be used. The outlet of the pump 14 is connected to the fitting 72*a* via a conduit 74*a*. As before, a hose 70 connects the fitting 72*a* to the suction cup-like member 58 to permit fluid communication between the outlet of the pump 14 and the suction cup-like member 58.

The catch basin 12*a* also includes a chute portion which is formed by a pair of support frames 94 and 96 and a liquid impermeable, flexible sheet 100. The support frame 94 has a long leg 114 and a short leg 122 which are substantially parallel to one another and are joined together by a first lateral support member 118. Similarly, the support frame 96 has a long leg 116 and a short leg 124 which are substantially parallel to one another and are joined together by a second lateral support member 120.

The short legs 122 and 124 are inserted into cylindrical sleeves 108 and 110, respectively, whereby the short legs 122 and 124 are oriented vertically and are fixed relative to one another and relative to the sump portion 90. The sleeves 108 and 110 are fixedly attached, with their longitudinal axes extending vertically, to the inner surface of the vertical wall of the sump portion 90. The sleeves 108 and 110 may be attached to the interior surface of the vertical wall of the sump portion 90 using any well known means such as welding, adhesive bonding, riveting or using screws. If screws or rivets are used, sealing means may have to be employed to prevent any liquid leaks around such screws or rivets.

The long legs 114 and 116 have one of their ends resting on a supporting surface such as the ground, while the other end of each of the long legs 114 and 116 is fixed to one end of a respective one of the lateral support members 118 and 120. The end of each of the lateral support members 118 and 120 distal from the respective long legs 114 and 116, is joined to a respective one of the short legs 122 and 124 proximate the upper end of each of the respective short legs 122 and 124. Because the long legs 114 and 116 rise higher than the short legs 122 and 124, the lateral support members 118 and 120 slope downward toward the sump portion 90. Further, each of the lateral support members 118 and 120 forms an acute inner angle with the respective one of the long legs 114 and 116, and each of the lateral support members 118 and 120 forms an obtuse inner angle with the respective one of the short legs 122 and 124.

The flexible sheet 100 has a wide upper end and a narrow lower end. The wide upper end is closer to the long legs 114 and 116, while the narrow lower end is close to the short legs 122 and 124. Each side of the sheet 100 has a lateral sleeve which envelopes a respective one of the lateral support members 118 and 120. The width of the sheet 100 at any point along its length is slightly wider than the distance between the lateral support members 118 and 120. This feature creates some slack in the sheet 100 which gives the sheet 100 a trough structure. The wide upper end of the sheet 100 being wider than the narrow lower end of the sheet 100, the long legs 114 and 116 are set farther apart than the short legs 122 and 124. The long legs 114 and 116 being higher than the short legs 122 and 124, the sheet 100 slopes downward into the sump portion 90. The narrow lower end of the sheet 100 overhangs the portion 102 of the rim of the open top of the sump portion 90. Thus, any liquid dripping onto the sheet 100 is directed into the sump portion 90. A portion 112 of the rim of the open top of the sump portion 90 is raised higher than the portion 102, thus leaving a raised arcuate strip 92 facing the narrow lower end of the sheet 100. The raised strip 92 acts as a splash guard.

The sheet 100 can be made of a plastic sheet, a rubberized fabric, or a plastic sheet laminated to a fabric sheet. The distance between the long legs 114 and 116 is fixed by the crossbar 98 which extends from the leg 114 to the leg 116. The crossbar 98 is supported at each end by a respective one of the pipe T-connectors 104 and 106. Each of the pipe T-connectors 104 and 106 is frictionally held about a respective one of the long legs 114 and 116. The frictional force holding the pipe T-connectors 104 and 106 about the long legs 114 and 116 is such that it can be overcome by a user as needed during the assembly process.

Figure 7:
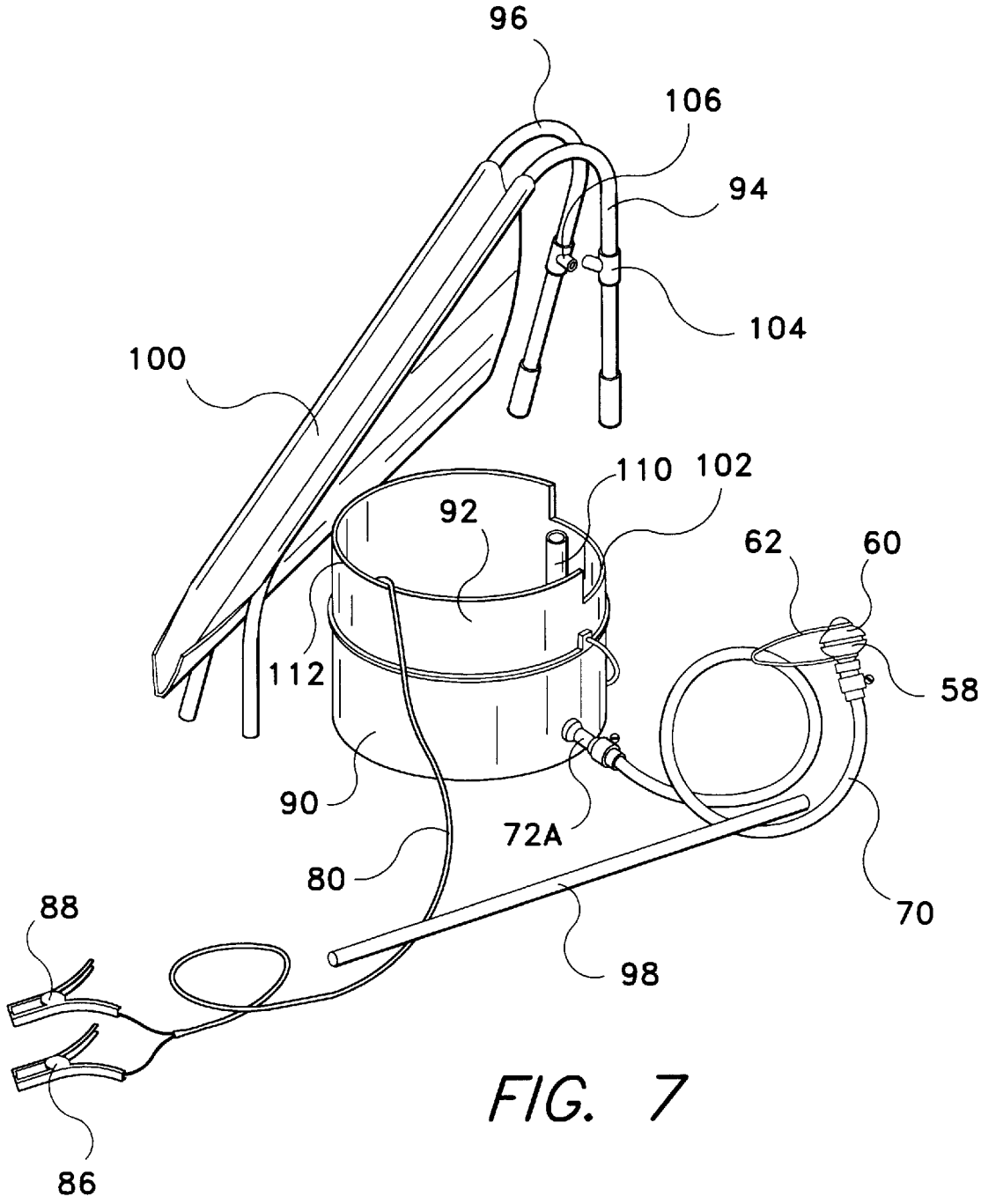
FIG. 7 is a perspective view of the second embodiment of the catch basin for use with the apparatus of the present invention for flushing the cooling system of marine motors, showing the catch basin in the disassembled condition.
Figure 8:
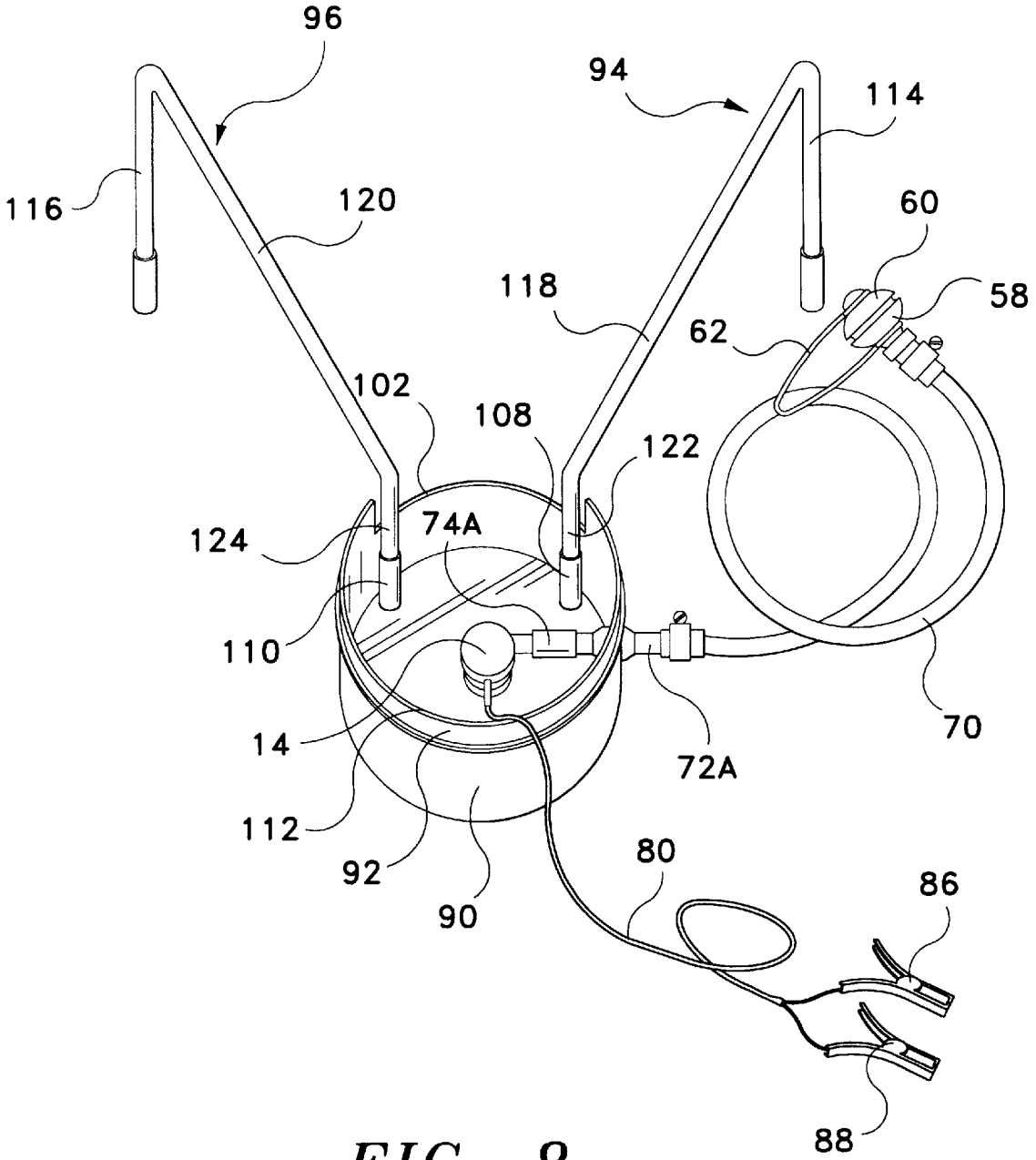
FIG. 8 is a top view showing the manner of attachment of the legs supporting the chute portion to the sump portion of the second embodiment of the catch basin for use with the apparatus of the present invention for flushing the cooling system of marine motors.

In use, the catch basin 12*a* is positioned under the outdrive 64 of the boat motor such that any liquid discharged from the exhaust 78 of the boat motor and from the area of the coolant intakes of the boat motor will fall onto the sump portion 90 and/or the sheet 100 and will ultimately be collected in the sump portion 90. The operation of the apparatus 10*a* is otherwise identical to the operation of the apparatus 10 which has already been described above. The advantage of the catch basin 12*a* over the catch basin 12 is that the catch basin 12*a* can be disassembled as shown in FIG. 7, and thus the apparatus 10*a* will take up less space during storage.

It is to be understood that the present invention is not limited to the embodiments described above, but encompasses any and all embodiments within the scope of the following claims.

I claim:

1. An apparatus for flushing a cooling system, the cooling system being that of a marine motor, the marine motor having an outdrive portion having first and second coolant intakes and coolant discharge means, the outdrive portion having a first surface portion surrounding the first coolant intake and a second surface portion surrounding the second coolant intake, the apparatus comprising:

a catch basin having a large enough capture area as viewed from above so as to capture any liquid emanating from the outdrive portion when said catch basin is placed under the outdrive portion;

a pump placed in said catch basin;

a first suction cup-like member adapted to cover the first coolant intake; and a hose being in fluid communication with said pump and with said first suction cup-like member, whereby when said suction cup-like member is placed over said first coolant intake, said second coolant intake being sealed from the atmosphere, said catch basin is placed under the outdrive of the boat motor, and a quantity of anti-freeze solution is placed in said catch basin, said pump can be operated to circulate the anti-freeze solution through the cooling system of the marine motor.

2. The apparatus for flushing a cooling system according to claim 1, wherein said catch basin includes a vessel having an underside and a pivoting support frame pivotally attached to said underside of said vessel, said pivoting support frame being movable between an extended position and a folded position, said vessel having a first lateral edge having a first end and a second end, a second lateral edge having a first end and a second end, a first transverse edge extending between said first end of said first lateral edge and said first end of said second lateral edge, and a second transverse edge extending between said second end of said first lateral edge and said second end of said second lateral edge, said first lateral edge, said second lateral edge, said first transverse edge, and said second transverse edge circumscribing said capture area, said vessel having an end wall having a perimeter defined by said first transverse edge and a remaining perimeter portion not including said first transverse edge, said vessel having a second wall joined to said end wall along said remaining perimeter portion, said second wall being bounded by said first lateral edge, said second lateral edge, said remaining perimeter portion, and said second transverse edge, said vessel being cooperatively supported on a supporting surface by said pivoting support frame in said extended position and a portion of said vessel located approximately at a point defined by the intersection of said remaining perimeter portion and a line perpendicularly bisecting said first transverse edge when said catch basin is in use, and said end wall and said second wall cooperatively holding a quantity of liquid when said catch basin is in use.

3. The apparatus for flushing a cooling system according to claim 2, wherein said end wall is circumscribed by a major arc of a circle and a chord which defines said first transverse edge, said major arc being coincident with said remaining perimeter portion, said second transverse edge being formed by a substantially flat bottom edge, a first side edge, and a second side edge, said first and second side edges rising upward on either side of said bottom edge, said second wall approximately following a curve defined by said second transverse edge proximate said second transverse edge, and said second wall more closely approaching a cylindrical contour with decreasing distance from said end wall.

4. The apparatus for flushing a cooling system according to claim 3, wherein said end wall has a hole extending therethrough, and said pump has an inlet and an outlet, the apparatus further including:

a fitting positioned to extend through said hole formed in said end wall; and a conduit connected to said outlet of said pump and to said fitting, said conduit allowing fluid communication between said outlet of said pump and said fitting, said hose being connected to said fitting and to said first suction cup-like member to thereby provide for fluid communication between said fitting and said first suction cup-like member.

5. The apparatus for flushing a cooling system according to claim 4, wherein said pump is electrically powered, the apparatus further including:

a cable having a first end and a second end, said first end of said cable being connected to said pump; and a pair of spring loaded battery terminal clamps provided at said second end of said cable to thereby allow said pump to be powered by a battery.

6. The apparatus for flushing a cooling system according to claim 4, the apparatus further including:

a U-shaped spring having a pair of arms each having a free end; and a second suction cup-like member provided at said free end of a first one of said pair of arms, said first suction cup-like member being provided at said free end of a second one of said pair of arms, said U-shaped spring biasing said first and second suction cup-like members into contact with the first surface portion surrounding the first coolant intake and the second surface portion surrounding the second coolant intake, respectively, when said first and second suction cup-like members are positioned to cover the first and second coolant intakes, respectively.

7. The apparatus for flushing a cooling system according to claim 1, wherein said catch basin includes:

a sump portion having an open top defined by a rim;

a flexible sheet having an area, a first end, and a second end; and a frame supporting said flexible sheet such that said first end of said sheet is higher than said second end of said sheet and said second end of said sheet overhangs a first portion of said rim of said sump portion when said catch basin is in use, said area of said sheet and said open top of said sump portion defining said capture area.

8. The apparatus for flushing a cooling system according to claim 7, wherein said frame includes a first short leg, a first long leg, a first lateral support member extending between said first long leg and said first short leg, a second short leg, a second long leg, a second lateral support member extending between said second long leg and said second short leg, and a crossbar extending from said first long leg to said second long leg, said first short leg and said second short leg are supported by said sump portion, and said sheet extends between said first lateral support member and said second lateral support member, when said catch basin is in a fully assembled configuration.

9. The apparatus for flushing a cooling system according to claim 8, wherein said sump portion has a hole extending therethrough, and said pump has an inlet and an outlet, the apparatus further including:

a fitting positioned to extend through said hole formed in said sump portion; and a conduit connected to said outlet of said pump and to said fitting, said conduit allowing fluid communication between said outlet of said pump and said fitting, said hose being connected to said fitting and to said first suction cup-like member to thereby provide for fluid communication between said fitting and said first suction cup-like member.

10. The apparatus for flushing a cooling system according to claim 9, wherein said pump is electrically powered, the apparatus further including:

a cable having a first end and a second end, said first end of said cable being connected to said pump; and a pair of spring loaded battery terminal clamps provided at said second end of said cable to thereby allow said pump to be powered by a battery.

11. The apparatus for flushing a cooling system according to claim 10, the apparatus further including:

a U-shaped spring having a pair of arms each having a free end; and a second suction cup-like member provided at said free end of a first one of said pair of arms, said first suction cup-like member being provided at said free end of a second one of said pair of arms, said U-shaped spring biasing said first and second suction cup-like members into contact with the first surface portion surrounding the first coolant intake and the second surface portion surrounding the second coolant intake, respectively, when said first and second suction cup-like members are positioned to cover the first and second coolant intakes, respectively.

12. A method for flushing a cooling system, the cooling system being that of a marine motor, the marine motor having an outdrive portion having first and second coolant intakes and coolant discharge means, the outdrive portion having a first surface portion surrounding the first coolant intake and a second surface portion surrounding the second coolant intake, the method comprising the steps of:

elevating the outdrive portion of the marine motor above a supporting surface;

providing a catch basin having a large enough capture area as viewed from above so as to capture any liquid emanating from the outdrive portion of the marine motor;

placing the catch basin under the outdrive portion of the marine motor;

providing a pump placed in the catch basin;

providing a pair of suction cup-like members which are connected by a U-shaped spring;

arranging for fluid communication between the pump and a first one of the pair of suction cup-like members;

covering each of the first and second coolant intakes with a respective one of the pair of suction cup-like members;

placing a quantity of anti-freeze solution in the catch basin;

operating the pump to supply anti-freeze solution to the first one of the pair of suction cup-like members; and turning on the marine motor to thereby repeatedly circulate anti-freeze solution through the cooling system of the marine motor and capture the anti-freeze solution as it is discharged from the coolant discharge means.

* * * * *